US011315400B1

(12) United States Patent
Madden et al.

(10) Patent No.: US 11,315,400 B1
(45) Date of Patent: Apr. 26, 2022

(54) APPEARANCE BASED ACCESS VERIFICATION

(71) Applicant: Alarm.com Incorporated, Tysons, VA (US)

(72) Inventors: Donald Madden, Columbia, MD (US); Celine Heckel Jones, Arlington, VA (US)

(73) Assignee: Alarm.com Incorporated, Tysons, VA (US)

( * ) Notice: Subject to any disclaimer, the term of this patent is extended or adjusted under 35 U.S.C. 154(b) by 48 days.

(21) Appl. No.: 17/032,648

(22) Filed: Sep. 25, 2020

Related U.S. Application Data

(63) Continuation of application No. 16/135,310, filed on Sep. 19, 2018, now Pat. No. 10,789,820.

(60) Provisional application No. 62/560,336, filed on Sep. 19, 2017.

(51) Int. Cl.
*G08B 13/196* (2006.01)
*G08B 15/00* (2006.01)

(52) U.S. Cl.
CPC ..... *G08B 13/19645* (2013.01); *G08B 15/00* (2013.01)

(58) Field of Classification Search
CPC ..... G06K 9/00771; G06K 2009/00738; G06K 9/00335; G06K 9/0063; G08B 25/008; G08B 19/00
See application file for complete search history.

(56) References Cited

U.S. PATENT DOCUMENTS

| | | | | |
|---|---|---|---|---|
| 6,204,762 | B1 | 3/2001 | Dering et al. | |
| 9,640,055 | B2 | 5/2017 | Fadell et al. | |
| 9,881,474 | B2 | 1/2018 | Fadell et al. | |
| 2006/0274949 | A1* | 12/2006 | Gallagher | G06K 9/00697 382/228 |
| 2007/0154088 | A1 | 7/2007 | Goh et al. | |
| 2009/0146829 | A1* | 6/2009 | Whillock | G06F 16/784 340/686.6 |
| 2014/0266669 | A1 | 9/2014 | Fadell et al. | |
| 2015/0029335 | A1 | 1/2015 | Kasmir et al. | |
| 2015/0138332 | A1 | 5/2015 | Cheng et al. | |
| 2016/0105644 | A1 | 4/2016 | Smith et al. | |
| 2016/0180667 | A1 | 6/2016 | Bunker et al. | |
| 2016/0203370 | A1 | 7/2016 | Child et al. | |
| 2016/0217638 | A1* | 7/2016 | Child | H04L 12/2803 |

* cited by examiner

*Primary Examiner* — Clifford Hilaire
(74) *Attorney, Agent, or Firm* — Fish & Richardson P.C.

(57) ABSTRACT

A computer implemented method, including receiving, by a monitoring system that is configured to monitor a property and from a first camera that is trained on a vicinity of an entry point of the property, first image data, determining that a visitor is located at the vicinity of the entry point of the property, generating, by the monitoring system, an appearance model of the visitor, receiving, by the monitoring system and from a second camera that is trained on an area of the property other than the vicinity of the entry point of the property, second image data, comparing, by the monitoring system, the second image data to the appearance model of the visitor, determining a confidence score that reflects a likelihood that the visitor is located at the area of the property other than the vicinity of the entry point, and performing a monitoring system action.

20 Claims, 5 Drawing Sheets

APPEARANCE BASED ACCESS VERIFICATION

CROSS REFERENCE TO RELATED APPLICATION

This application is a continuation application of and claims priority to U.S. application Ser. No. 16/135,310, filed Sep. 19, 2018, which claims the benefit of U.S. Provisional Application No. 62/560,336, filed Sep. 19, 2017, and titled "Appearance Based Access Verification," which is incorporated by reference in its entirety.

TECHNICAL FIELD

This disclosure relates to property monitoring technology.

BACKGROUND

Many people equip homes and businesses with monitoring systems to provide increased security for their homes and businesses.

SUMMARY

Techniques are described for monitoring technology. For example, techniques are described for generating an appearance based model of a visitor that is granted access to a monitored property. One or more cameras capture video data and images of a visitor as the visitor approaches and gains access to the monitored property. The system uses the captured data to generate an appearance model of the visitor, and monitors the visitor throughout the property to confirm, by comparing to the generated appearance model, whether the visitor within the property is the same person that gained access to the property.

According to an innovative aspect of the subject matter described in this application, a monitoring system that is configured to monitor a property, the monitoring system includes a first camera that is configured to generate first image data and that is trained on a vicinity of an entry point of the property, a second camera that is configured to generate second image data and that is trained on an area of the property other than the vicinity of the entry point of the property, and a monitoring control unit. The monitoring control unit is configured to receive, from the first camera, the first image data, based on the first image data, determine that a visitor is located at the vicinity of the entry point of the property, based on determining that a visitor is located at the vicinity of the entry point of the property, generate an appearance model of the visitor, receive, from the second camera, the second image data, based on determining that the second image data includes a representation of a person, compare the second image data to the appearance model of the visitor, based on comparing the second image data to the appearance model of the visitor, determine a confidence score that reflects a likelihood that the visitor is located at the area of the property other than the vicinity of the entry point, and based on the confidence score that reflects a likelihood that the visitor is located at the area of the property other than the vicinity of the entry point, perform a monitoring system action.

These and other implementations each optionally include one or more of the following optional features. The monitoring control unit is configured to determine that the visitor located at the vicinity of the entry point of the property is likely an expected visitor, wherein the area of the property other than the vicinity of the entry point is restricted to the expected visitor, determine a confidence score that reflects a likelihood that the visitor is located at the area of the property other than the vicinity of the entry point by determining a confidence score that reflects a likelihood that the visitor is located at the area of the property that is restricted to the visitor, determine that the confidence score that reflects the likelihood that the visitor is located at the area of the property that is restricted to the visitor satisfies a threshold score, based on determining that the confidence score that reflects the likelihood that the visitor is located at the area of the property that is restricted to the visitor satisfies the threshold score, determine that the visitor is likely at the area of the property that is restricted to the visitor, and perform a monitoring system action by generating an audible alarm at the property based on determining that the visitor is likely at the area of the property that is restricted to the visitor. The monitoring control unit is configured to perform a monitoring system action by commanding a speaker to output a voice command instructing the visitor to vacate the area of the property that is restricted to the visitor based on determining that the visitor is likely at the area of the property that is restricted to the visitor.

The monitoring control unit is configured to receive an expected time of arrival of the expected visitor and data indicating an area of the property that is restricted to the expected visitor, wherein the second camera is trained on the area of the property that is restricted to the expected visitor, determine that the visitor located at the vicinity of the entry point of the property is likely the expected visitor, based on comparing a time that the visitor is located at the vicinity of the entry point of the property to the expected time of arrival of the expected visitor, determine that the visitor located at the vicinity of the entry point of the property is likely the expected visitor. The monitoring control unit is configured to determine that the visitor located at the vicinity of the entry point of the property is likely an expected visitor, where the expected visitor is expected to be alone, the expected visitor is permitted to access the additional area of the property other than the vicinity of the entry point, and no residents of the property are at the property, compare the confidence score that reflects the likelihood that the visitor is located at the area of the property other than the vicinity of the entry point to a confidence score threshold, based on comparing the confidence score that reflects the likelihood that the visitor is located at the area of the property other than the vicinity of the entry point to the confidence score threshold, determine that the confidence score does not satisfy the confidence score threshold, based on determining that the confidence score does not satisfy the confidence score threshold, determine that a person in the area of the property other than the vicinity of the entry point is not the visitor, and perform the monitoring system action based on determining that the person in the area of the property other than the vicinity of the entry point is not the visitor.

The monitoring control unit is configured to perform a monitoring system action by providing a notification to a user device of a resident of the property or commanding a speaker at the property to output a voice command instructing the person to vacate the property based on determining that a person other than the visitor is likely at the additional area of the property. The monitoring control unit is configured to receive, from an additional visitor, a disarm code, determine that the disarm code matches a stored code that is assigned to an expected visitor, determine a number of persons expected to accompany the expected visitor, compare the number of persons expected to accompany the expected visitor to a number of persons represented in additional first image data, based on comparing the number of persons expected to accompany the expected visitor to a number of persons represented in the additional first image data, determine that the number of persons does not match the number of persons expected to accompany the expected visitor, and based on determining that the number of persons does not match the number of persons expected to accompany the expected visitor, deny the additional visitor access to the property. The monitoring control unit is configured to determine that the visitor located at the vicinity of the entry point of the property is likely an expected visitor, wherein the expected visitor is expected to be accompanied by a particular number of persons, the expected visitor is permitted to access the additional area of the property other than the vicinity of the entry point, and no residents of the property are at the property, based on the confidence score that reflects a likelihood that the visitor is located at the area of the property other than the vicinity of the entry point, determine that the visitor is likely located at the area of the property other than the vicinity of the entry point, determine that the second image data includes a representation of a number of persons other than the visitor plus the particular number of persons, and perform the monitoring system action based on determining that the second image data includes a representation of a number of persons other than the visitor plus the particular number of persons.

The monitoring system further includes a sensor that is located in additional area of the property and that is configured to generate sensor data. The monitoring control unit is configured to determine that the visitor located at the vicinity of the entry point of the property is likely an expected visitor, wherein the expected visitor is expected to be alone, the expected visitor is permitted to access the additional area of the property other than the vicinity of the entry point, and no residents of the property are at the property, based on the confidence score that reflects a likelihood that the visitor is located at the area of the property other than the vicinity of the entry point, determine that the visitor is likely located at the area of the property other than the vicinity of the entry point, receive, from the sensor, the sensor data, based on the sensor data, determine that a person is likely located in the additional area of the property while the visitor is likely located at the area of the property other than the vicinity of the entry point, and perform the monitoring system action based on determining that a person is likely located in the additional area while the visitor is likely located at the area of the property other than the vicinity of the entry point.

The monitoring control unit is configured to determine that the second image data includes a representation of the visitor, and based on the second image data, update the appearance model of the visitor. The monitoring control unit is configured to generate an appearance model for the visitor in the vicinity of the front door of the property by estimating a height, weight, size, facial features, gait, and other physical characteristics of the visitor. The monitoring control unit is configured to determine an armed status of the monitoring system, based on determining that the monitoring system is armed, adjust a confidence score threshold, compare the confidence score to the adjusted confidence score threshold, and perform a monitoring system action based on comparing the confidence score to the adjusted confidence score threshold.

According to another innovative aspect of the subject matter described in this application, a computer implemented method, includes receiving, by a monitoring system that is configured to monitor a property and from a first camera that is trained on a vicinity of an entry point of the property, first image data, based on the first image data, determining, by the monitoring system that a visitor is located at the vicinity of the entry point of the property, based on determining that a visitor is located at the vicinity of the entry point of the property, generating, by the monitoring system, an appearance model of the visitor, receiving, by the monitoring system and from a second camera that is trained on an area of the property other than the vicinity of the entry point of the property, second image data, based on determining that the second image data includes a representation of a person, comparing, by the monitoring system, the second image data to the appearance model of the visitor, based on comparing the second image data to the appearance model of the visitor, determining, by the monitoring system, a confidence score that reflects a likelihood that the visitor is located at the area of the property other than the vicinity of the entry point, and based on the confidence score that reflects a likelihood that the visitor is located at the area of the property other than the vicinity of the entry point, performing a monitoring system action.

Implementations of the described techniques may include hardware, a method or process implemented at least partially in hardware, or a computer-readable storage medium encoded with executable instructions that, when executed by a processor, perform operations.

The details of one or more implementations are set forth in the accompanying drawings and the description below. Other features will be apparent from the description and drawings, and from the claims.

DETAILED DESCRIPTION

Techniques are described for integrating a monitoring system with one or more cameras configured to capture video and image data of a visitor as the visitor approaches and gains access to a monitored property. The video and image data captured by the one or more cameras is communicated to a control unit of the monitoring system, and the control unit generates an appearance based model for the visitor. The visitor may be an individual that is given temporary access to the property to perform a service. For example, a technician, a plumber, house keeper, or any other suitable individual that could be given temporary access to a property. The control unit may assess the height, weight, facial features, gait, and other physical characteristics of the visitor to generate the appearance based model. One or more sensors and cameras distributed throughout the monitored property may be used to monitor the visitor through the property. The control unit may generate an alarm when the system detects a discrepancy between appearance and or the number of persons within the property. For example, the control unit may generate an alarm when the visitor gained access with one other person but the control unit detected four other persons within the monitored property.

Figure 1A:
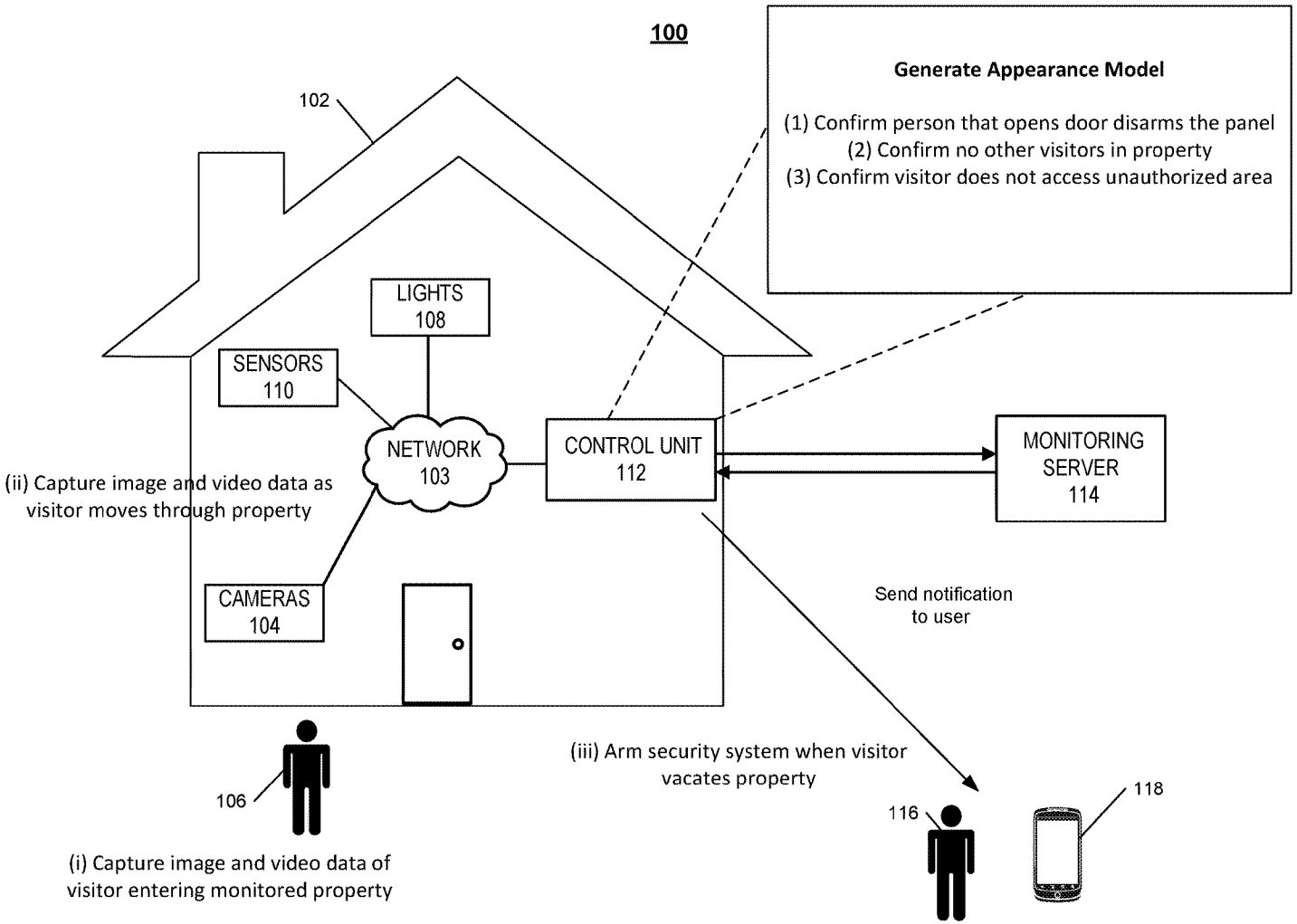
FIGS. 1A and 1B illustrate examples of systems that verify a visitor at a monitored property based on a generated appearance model.
Figure 1B:
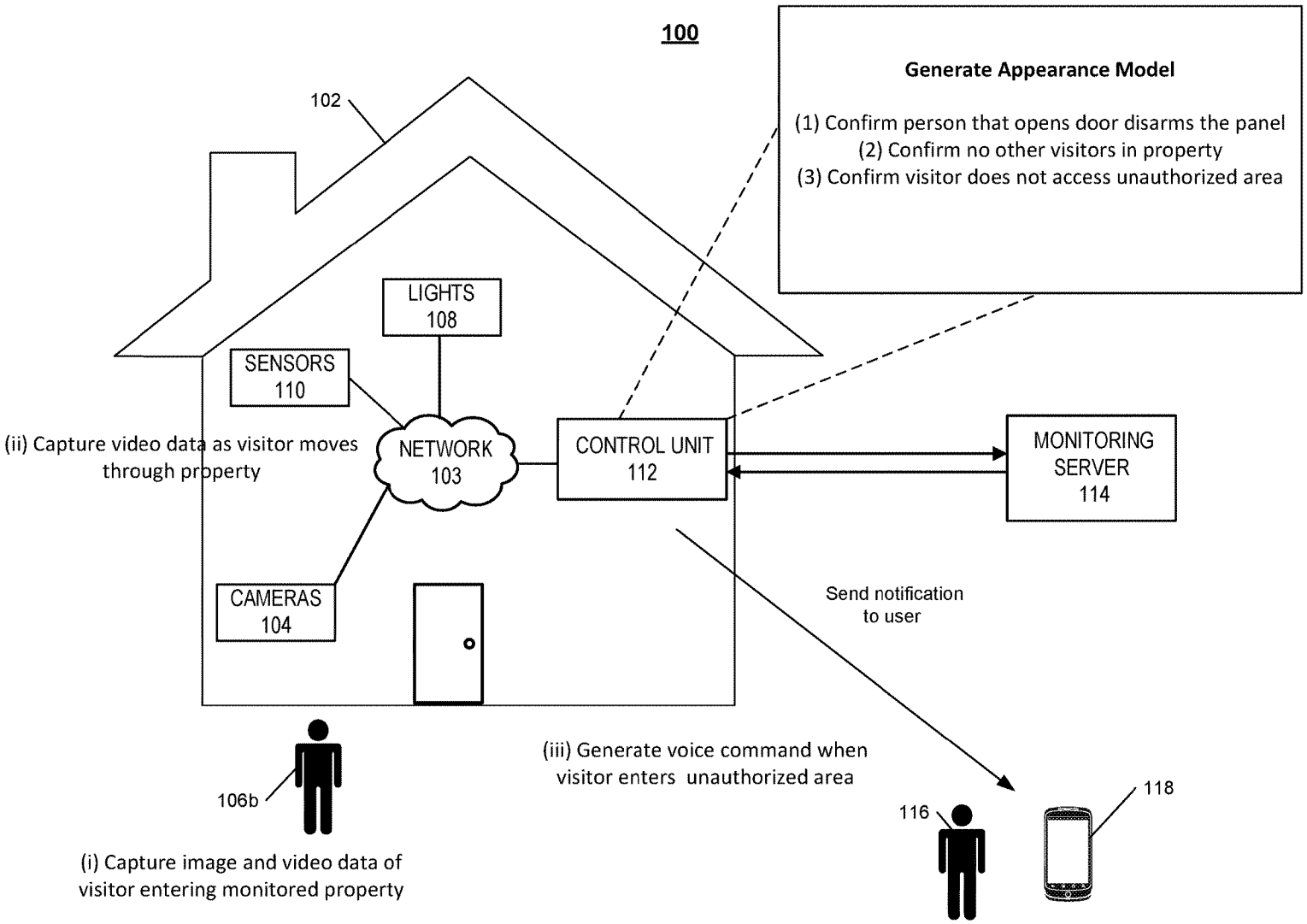

FIGS. 1A and 1B illustrate examples of a monitoring system 100 integrated with one or more cameras 104 and one or more sensors 110. As shown, a property 102 (e.g. a home) of a user 116 is monitored by an in-home monitoring system (e.g. in-home security system) that includes components that are fixed within the property 102. The in-home monitoring system may include a control unit 112, one or more cameras 104, one or more sensors 110, and one or more lights 108. The user 116 may integrate the one or more cameras 104 and one or more sensors 110 into the in-home monitoring system to monitor visitors while they move through the property 102.

For the examples shown in FIGS. 1A and 1B a visitor 106 may approach the front door of the monitored property 102. The visitor 106 may be an individual that the user 116 grants access to the monitored property 102 when the user 116 is away. A visitor may be an individual that is scheduled to perform a service at the monitored property 102, such as, a technician, an electrician, a plumber, a dog walker, or a baby sitter etc. The visitor 106 may gain access to the monitored property 102 by using a physical key, a passcode, or a token to unlock the front door. The monitored property 102 may be equipped with a front door camera that captures image and video data of a visitor when the visitor 106 is within the field of view of the front door camera. The front door camera communicates the captured video and image data to the control unit 112. The control unit 112 analyzes the captured video and image data to generate an appearance model of the visitor 106. The appearance model of the visitor 106 may assess the physical characteristics of the visitor as the visitor approaches the front door of the property 102. For example, the control unit may analyze the received video data to determine the gait of the visitor. The control unit 112 may also assess the height, size, weight, and the facial features of the visitor 106.

The visitor 106 may disarm the in-home security system by entering a disarm code received from the user 116 into the keypad of the control panel of the in-home security system. The disarm code may be a time sensitive code that is only valid for the day and time of the scheduled service appointment. For example, the disarm code may be valid from 8:00 AM to 9:00 AM for an 8:00 AM appointment. In some examples, the user 116 may communicate the disarm code to a mobile device of the visitor 106. In other examples, the monitoring server 114 may communicate the disarm code to the mobile device of the visitor 106. In these examples, the monitoring server 114 may be in communication with a third party server that facilitates the scheduling of services at the monitoring property.

The control panel of the in-home security system may include a camera that captures one or more images and video data of the visitor 106 as the visitor enters the disarm code. The control unit 112 associates the generated appearance model with the disarm code used by the visitor. The monitored property 102 may be equipped with one or more cameras 104 near the entry way of the front door that capture video and image data of the visitor 106 as the visitor enters the property 102 and walks to the control panel to disarm the system. The captured video and image data are communicated to the control unit 112. The control unit 112 compares the generated appearance model of the visitor 106 to received video and image data to verify that the visitor 106 that accessed the property 102 is the same person that disarms the control panel. When the control unit 112 confirms the person that disarms the control panel is the visitor 106, the control unit updates the appearance model based on the new video and image data.

The control unit 112 associates the disarm code used to disarm the in-home security system with the appearance model generated for the visitor 106. In some implementations, the control unit 112 may store the appearance model in memory for returning visitors. For example, the control unit may store the appearance model generated for the dog walker. The dog walker receives a unique disarm code that is specific to the dog walker. When the dog walker first visits the monitored property, the control unit 112 generates an appearance model based on the image and video data of the dog walker obtained during the first visit. The control unit 112 may store the generated appearance model in memory. When the dog walker returns to the monitored property 102, the one or more cameras may capture images of the dog walker, based on identifying a match with the stored appearance model of the dog walker, the control unit 112 recognizes the dog walker as a return visitor. The dog walker confirms to the control unit 112 that he is a return visitor when the dog walker enters the disarm code specific to the dog walker. The control unit 112 may update the generated model for a return visitor each time the control unit 112 receives video and image data of the visitor. Updating the generated appearance model with newly received image and video data allows the control unit 112 to strengthen the model, to adapt to changes in appearances of a particular person over time, and to strengthen the determinations made using the model.

The control unit 112 captures video and image data of the visitor 106 as the visitor moves from room to room within the monitored property 102. The monitored property 102 is equipped with a plurality of motion sensors 110 which are configured to detect motion caused when a person enters a room. When at least one motion sensor detects a person entering a room, the control unit 112 prompts one or more cameras 104 near the at least one motion sensor to capture video and image data. In some examples, each of the one or more rooms of the monitored property are equipped with at least one camera that is configured to initiate the capture of video and image data when a person is within the field of view of the camera. The one or more cameras may be configured to pan and or tilt to adjust its field of view, and to capture video and image data of the person until the person moves to another room within the field of view of a second camera.

The control unit 112 compares the captured video and image data of the detected person to the generated appearance model of the visitor 106 to confirm that the detected person is visitor 106. Based on confirming that there is a match between the appearance of the detected person and the generated appearance model, the control unit 1112 updates the appearance model based on the newly captured video and image data. The control unit 112 may determine a match score for the detected person, and based on the match score of the detected person exceeding a predetermined threshold the control unit 112 determines that the detected person is the visitor. In some implementations, the control unit 112 confirms a match between the visitor and the generated appearance model using facial recognition. In these examples, the control unit 112 may identify a match when comparing the captured images to one or more images used to generate the appearance model. In some examples, where the control unit 112 does not receive image and video data where the facial features of the visitor can be identified, the control unit 112 may rely on features such as the height, weight, gait, and clothes worn by the visitor to make the determination. For example, the video and image data of the visitor may only include low resolution data video and image data that was obtained from a distance, based on this, the control unit 112 may determine a match based features such as the visitor's gait, height, and weight matching the generated model.

The control unit 112 may automatically rearm the in-home monitoring system when the visitor vacates the property 102. The front door camera may capture video and image data of the visitor as the visitor closes the front door and walks away from the property 102. The control unit 112 receives the captured video and image data from the front door camera, and confirms a match between the person departing the property 102 and the generated appearance model. Based on the control unit 112 confirming a match, the control unit 112 rearms the in-home security system at the monitored property 102. The control unit 112 may communicate a notification to the user device 118 of the user 116 indicating that the visitor 116 left the property. The notification may include the time of arrival of the visitor, the disarm code used, and the time of departure of the visitor. In some implementations, the notification may include one or more images of the visitor. In some implementations, the control unit 112 communicates the notification to the monitoring server 114, and the monitoring server 114 communicates the notification to the user device 118 of the user 116.

The monitoring server 114 is a backend server that manages a monitoring application. The monitoring server 114 may be in communication with a third party server that facilitates the scheduling of in-home services. The user 116 may log into the monitoring application to schedule services from one or more providers. For example, the user may schedule a cable installation appointment for 1:00 PM on Monday. The third party server may schedule the appointment with the cable company and may receive details about the cable technician scheduled for the appointment. The third party server may provide the biometric information associated with the cable technician to the monitoring server 114. The monitoring server 114 may provide the cable technician with the disarm code for the in-home security system. The monitoring server 114 may communicate the technician's biometric information to the control unit 112. When the cable technician arrives at the monitored property 102 and disarms the in-home monitoring system, the control unit 112 verifies the identity of the technician based on comparing the one or more captured images of the technician to the biometric information received from the monitoring server 114.

In some implementations, the control panel 112 of the in-home security system may be configured to be disarmed through a voice command of the disarm code. In these examples, the visitor 106 may speak the disarm code into a speaker of the control panel 112 to disarm the security system at the property 102. The control unit 112 may receive the voice input of the visitor 106, and may integrate the voice data into the generated model. In these examples, the one or more sensors 110 around the monitored property 102 with microphone functionality may capture voices as the visitor moves through the property 102. The control unit 112 may compare the detected voices throughout the property 102 to the voice used to disarm the in-home security system. In other implementations, the generated appearance model for a visitor may be associated with other biometric information associated with the visitor. For example, when the control panel 112 is integrated with a retina or iris scanner, or a finger print reader, the control unit 112 may capture the biometric data of a visitor and associate the biometrics with the generated appearance model.

In some implementations, the control unit 112 may store one or more generated appearance models in memory. The one or more stored appearance models may include one or more appearance models for return visitors. For example, the control unit 112 may store a generated appearance model for the house keeper, the dog walker, and the gardener. In some examples, where a visitor is accompanied by one or more other persons, the control unit 112 generates an appearance based model for the visitor and each of the one or more other persons. For example, the user may schedule an electrician service call at the monitored property 102, and share the disarm code with the electrician. The electrician may arrive at the monitored property 102 with two assistants. As the electrician and the two assistants approach the front door, the front door camera may capture video and image data of each of the persons. The control unit 112 may associate the disarm code used by the electrician with the generated model for the electrician, and may generate an appearance model for each of the two assistants. When a person is detected in a room of the property 102, the control unit 112 may compare the images and video of the person to each of the one or more generated appearance models to confirm that person is the electrician or one of the assistants.

As illustrated in FIG. 1B, the control unit 112 generates an alarm when the control unit 112 determines that the visitor 106*b* moves to an unauthorized area of the property 102. The user 116 may set restricted area preferences for one or more visitors scheduled at the monitored property 102. The user 116 may access the monitoring application on the user device 118 to set the preferences. The user 116 may identify the one or more rooms within the property that are restricted, and may set the action to be taken by the control unit in response to a visitor entering a restricted area.

As the visitor 106 moves through the monitored property 102, one or more cameras capture image and video data of the visitor in the different rooms of the property 102. When the user enters a restricted room, the one or more cameras in the room capture video and image data of the visitor 106*b*. The captured video and image data is communicated to the control unit 112. The control unit 112 compares the captured data to the generated appearance model for the visitor 106*b*. Based on the control unit 112 identifying a match with the generated appearance model, the control unit 112 determines that the preferences associated with the visitor 106*b* does not allow access to the particular room. Based on the user set preferences, the control unit 112 communicates a notification to the user device 118 of the user 116. The notification may include an image of the visitor, the disarm code used, the time of entry into the monitored property 102, and may indicate the room the visitor 106*b* entered. The control unit 112 may prompt a microphone device to output a voice command instructing the visitor to vacate the room immediately or an alarm will be sounded. For example, the dog walker may enter the office, and the Amazon Echo may output a voice command urging the dog walker to leave the room. In some examples, when the visitor 106*b* enters a restricted area the control unit 112 may generate an audible alarm.

In some implementations, when the in-home security system is armed away, the control unit 112 assumes that none of the residents of the monitored property are within the property 102. In these implementations, when the visitor 106 approaches the monitored property 102, the control unit 112 captures image and video data of the visitor, and compares the captured data to stored images of the one or more residents of the monitored property 102. When the control unit 112 confirms that the visitor 106 is not a resident of the monitored property 102, the control unit 112 uses the captured data to generate an appearance model of the visitor 106. The control unit 112 may prompt each of the one or more motion sensors located throughout the monitored property 102 to lower the threshold for detecting motion when the system is armed away. Lowering the threshold for the detection of motion increases the motion sensor's ability to detect the visitor 106 as the visitor moves through the monitored property 102. Each of the sensors within the visitor's path detects motion and will prompt one or more cameras to capture additional video and image data of the visitor to compare to, and update the generated appearance model.

In some implementations, when the in-home security system is armed stay, the control unit 112 assumes that at least one resident of the monitored property is within the property. Based on the monitoring system being armed stay, the control unit 112 may prompt each of the one or more motion sensors located throughout the monitored property 102 to increase the threshold for detecting motion within the property 102. The control unit 112 prompts the one or more cameras located throughout the monitored property 102 to capture video data to confirm whether the property 102 is occupied by a resident. When the control unit 112 confirms that none of the residents are within the monitored property 102, the control unit 112 may prompt the one or more sensors to lower the threshold for detecting motion based on detecting a visitor 106 entering the property 102.

Figure 2:
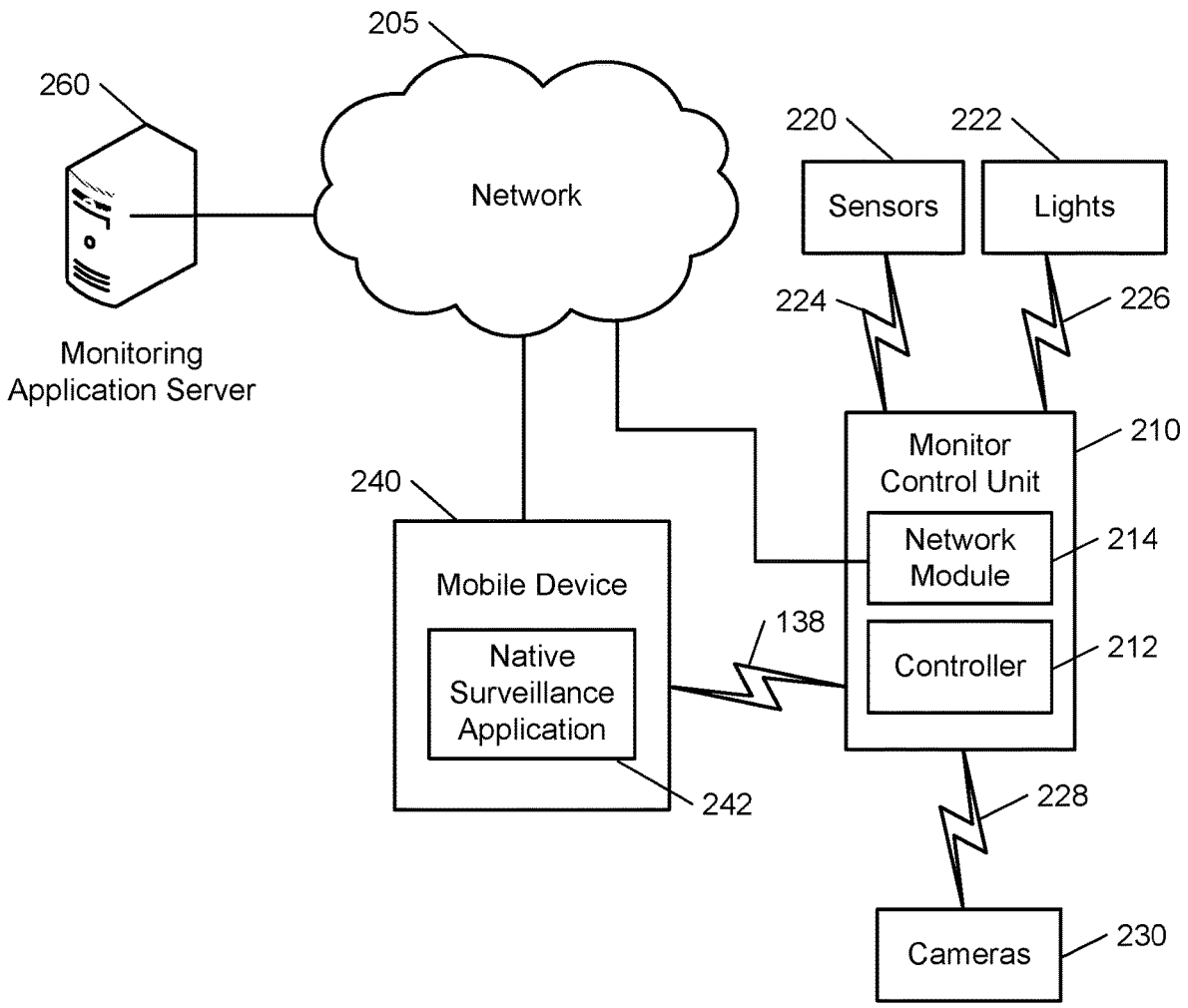
FIG. 2 illustrates an example of a monitoring system integrated with one or more cameras and one or more sensors.

FIG. 2 illustrates an example of a system 200 configured to monitor a property. The system 200 includes a network 205, a monitoring system control unit 210, one or more user devices 240, and a monitoring application server 260. The network 205 facilitates communications between the monitoring system control unit 210, the one or more user devices 240, and the monitoring application server 260. The network 205 is configured to enable exchange of electronic communications between devices connected to the network 205. For example, the network 205 may be configured to enable exchange of electronic communications between the monitoring system control unit 210, the one or more user devices 240, and the monitoring application server 260. The network 205 may include, for example, one or more of the Internet, Wide Area Networks (WANs), Local Area Networks (LANs), analog or digital wired and wireless telephone networks (e.g., a public switched telephone network (PSTN), Integrated Services Digital Network (ISDN), a cellular network, and Digital Subscriber Line (DSL)), radio, television, cable, satellite, or any other delivery or tunneling mechanism for carrying data. Network 205 may include multiple networks or subnetworks, each of which may include, for example, a wired or wireless data pathway. The network 205 may include a circuit-switched network, a packet-switched data network, or any other network able to carry electronic communications (e.g., data or voice communications). For example, the network 205 may include networks based on the Internet protocol (IP), asynchronous transfer mode (ATM), the PSTN, packet-switched networks based on IP, X.25, or Frame Relay, or other comparable technologies and may support voice using, for example, VoIP, or other comparable protocols used for voice communications. The network 205 may include one or more networks that include wireless data channels and wireless voice channels. The network 205 may be a wireless network, a broadband network, or a combination of networks including a wireless network and a broadband network.

The monitoring system control unit 210 includes a controller 212 and a network module 214. The controller 212 is configured to control a monitoring system (e.g., a home alarm or security system) that includes the monitor control unit 210. In some examples, the controller 212 may include a processor or other control circuitry configured to execute instructions of a program that controls operation of an alarm system. In these examples, the controller 212 may be configured to receive input from indoor door knobs, sensors, detectors, or other devices included in the alarm system and control operations of devices included in the alarm system or other household devices (e.g., a thermostat, an appliance, lights, etc.). For example, the controller 212 may be configured to control operation of the network module 214 included in the monitoring system control unit 210.

The network module 214 is a communication device configured to exchange communications over the network 205. The network module 214 may be a wireless communication module configured to exchange wireless communications over the network 205. For example, the network module 214 may be a wireless communication device configured to exchange communications over a wireless data channel and a wireless voice channel. In this example, the network module 214 may transmit alarm data over a wireless data channel and establish a two-way voice communication session over a wireless voice channel. The wireless communication device may include one or more of a GSM module, a radio modem, cellular transmission module, or any type of module configured to exchange communications in one of the following formats: LTE, GSM or GPRS, CDMA, EDGE or EGPRS, EV-DO or EVDO, UMTS, or IP.

The network module 214 also may be a wired communication module configured to exchange communications over the network 205 using a wired connection. For instance, the network module 214 may be a modem, a network interface card, or another type of network interface device. The network module 214 may be an Ethernet network card configured to enable the monitoring control unit 210 to communicate over a local area network and/or the Internet. The network module 214 also may be a voiceband modem configured to enable the alarm panel to communicate over the telephone lines of Plain Old Telephone Systems (POTS).

The monitoring system may include multiple sensors 220. The sensors 220 may include a contact sensor, a motion sensor, a glass break sensor, or any other type of sensor included in an alarm system or security system. The sensors 220 also may include an environmental sensor, such as a temperature sensor, a water sensor, a rain sensor, a wind sensor, a light sensor, a smoke detector, a carbon monoxide detector, an air quality sensor, etc. The sensors 220 further may include a health monitoring sensor, such as a prescription bottle sensor that monitors taking of prescriptions, a blood pressure sensor, a blood sugar sensor, a bed mat configured to sense presence of liquid (e.g., bodily fluids) on the bed mat, etc. In some examples, the sensors 220 may include a radio-frequency identification (RFID) sensor that identifies a particular article that includes a pre-assigned RFID tag. The sensors 220 may include a one or more metal induction proximity sensors. The metal induction proximity sensors are configured to detect the metal of a vehicle when the vehicle moves close to the proximity sensor. The one or more proximity sensors may be configured to detect the changes in the electromagnetic field of a sensor caused by a metal object moving close to the sensor.

The monitoring system may one or more other cameras 230. Each of the one or more cameras 230 may be video/ photographic cameras or other type of optical sensing device configured to capture images. For instance, the cameras may be configured to capture images of an area within a building monitored by the monitor control unit 210. The cameras may be configured to capture single, static images of the area and also video images of the area in which multiple images of the area are captured at a relatively high frequency (e.g., thirty images per second). The cameras may be controlled based on commands received from the monitor control unit 210.

The cameras may be triggered by several different types of techniques. For instance, a Passive Infra Red (PIR) motion sensor may be built into the cameras and used to trigger the one or more cameras 230 to capture one or more images when motion is detected. The one or more cameras 230 also may include a microwave motion sensor built into the camera and used to trigger the camera to capture one or more images when motion is detected. Each of the one or more cameras 230 may have a "normally open" or "normally closed" digital input that can trigger capture of one or more images when external sensors (e.g., the sensors 220, PIR, door/window, etc.) detect motion or other events. In some implementations, at least one camera 230 receives a command to capture an image when external devices detect motion or another potential alarm event. The camera may receive the command from the controller 212 or directly from one of the sensors 220.

In some examples, the one or more cameras 230 triggers integrated or external illuminators (e.g., Infra Red, Z-wave controlled "white" lights, lights controlled by the module 214, etc.) to improve image quality when the scene is dark. An integrated or separate light sensor may be used to determine if illumination is desired and may result in increased image quality.

The sensors 220, the lights 222, and the cameras 230 communicate with the controller 212 over communication links 224, 226, and 228. The communication links 224, 226, and 228 may be a wired or wireless data pathway configured to transmit signals from the sensors 220, the touchless doorbell device 222, and the cameras 230 to the controller 212. The communication link 224, 226, and 228 228 may include a local network, such as, 802.11 "Wi-Fi" wireless Ethernet (e.g., using low-power Wi-Fi chipsets), Z-Wave, Zigbee, Bluetooth, "HomePlug" or other Powerline networks that operate over AC wiring, and a Category 5 (CAT5) or Category 6 (CAT6) wired Ethernet network.

The monitoring application server 260 is an electronic device configured to provide monitoring services by exchanging electronic communications with the monitor control unit 210, and the one or more user devices 240, over the network 205. For example, the monitoring application server 260 may be configured to monitor events (e.g., alarm events) generated by the monitor control unit 210. In this example, the monitoring application server 260 may exchange electronic communications with the network module 214 included in the monitoring system control unit 210 to receive information regarding events (e.g., alarm events) detected by the monitoring system control unit 210. The monitoring application server 260 also may receive information regarding events (e.g., alarm events) from the one or more user devices 240.

The one or more user devices 240 are devices that host and display user interfaces. The user device 240 may be a cellular phone or a non-cellular locally networked device with a display. The user device 240 may include a cell phone, a smart phone, a tablet PC, a personal digital assistant ("PDA"), or any other portable device configured to communicate over a network and display information. For example, implementations may also include Blackberry-type devices (e.g., as provided by Research in Motion), electronic organizers, iPhone-type devices (e.g., as provided by Apple), iPod devices (e.g., as provided by Apple) or other portable music players, other communication devices, and handheld or portable electronic devices for gaming, communications, and/or data organization. The user device 240 may perform functions unrelated to the monitoring system, such as placing personal telephone calls, playing music, playing video, displaying pictures, browsing the Internet, maintaining an electronic calendar, etc.

The user device 240 includes a monitoring application 242. The monitoring application 242 refers to a software/firmware program running on the corresponding mobile device that enables the user interface and features described throughout. The user device 240 may load or install the monitoring application 242 based on data received over a network or data received from local media. The monitoring application 242 runs on mobile devices platforms, such as iPhone, iPod touch, Blackberry, Google Android, Windows Mobile, etc. The monitoring application 242 enables the user device 140 to receive and process image and sensor data from the monitoring system.

In some implementations, the one or more user devices 240 communicate with and receive monitoring system data from the monitor control unit 210 using the communication link 238. For instance, the one or more user devices 240 may communicate with the monitor control unit 210 using various local wireless protocols such as Wi-Fi, Bluetooth, Z-Wave, Zigbee, "HomePlug," or other Powerline networks that operate over AC wiring, or Power over Ethernet (POE), or wired protocols such as Ethernet and USB, to connect the one or more user devices 240 to local security and automation equipment. The one or more user devices 240 may connect locally to the monitoring system and its sensors and other devices. The local connection may improve the speed of status and control communications because communicating through the network 205 with a remote server (e.g., the monitoring application server 260) may be significantly slower.

Although the one or more user devices 240 are shown as communicating with the monitor control unit 210, the one or more user devices 240 may communicate directly with the sensors and other devices controlled by the monitor control unit 210. In some implementations, the one or more user devices 240 replace the monitoring system control unit 210 and perform the functions of the monitoring system control unit 210 for local monitoring and long range/offsite communication. Other arrangements and distribution of processing is possible and contemplated within the present disclosure.

Figure 3:
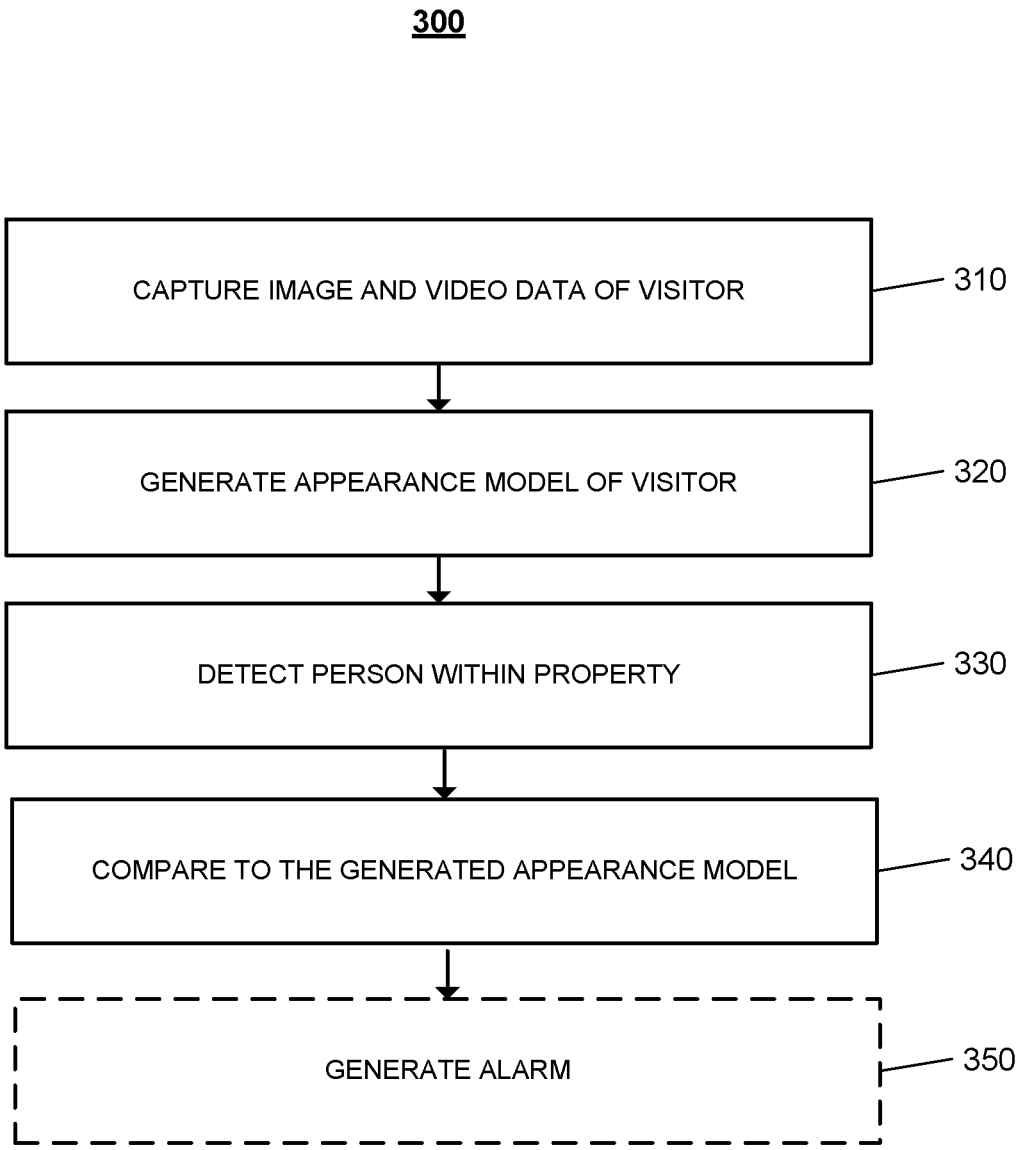
FIG. 3 is a flow chart of an example process for generating an alarm based on a generated appearance model.

FIG. 3 illustrates an example process 300 for generating an alarm. The one or more cameras capture image and video data of a visitor (310). The monitored property 102 may be equipped with one or more external cameras, including a front door camera, that are each configured to capture video and image data of a person approaching the property 102. In some examples, the one or more cameras are configured to initiate the capture of image and video data when a motion detector near at least one of the one or more cameras detects motion. The at least one camera may capture video data of the person as the person approaches the front door to accesses the property 102. The at least one camera may pan and or tilt to adjust it field of view to capture sufficient video and image data for processing. In other examples, the one or more cameras begin to capture image and video data when a human object moves into the field of view of at least one camera. Each of the one or more cameras may include a Passive Infrared Sensor (PIR) that is configured to detect heat radiated from living objects, and a low power light sensitive sensor that is configured to distinguish between a human and an animal. When a person moves into the field of view of at least one camera, and the camera determines the living object has a human form, the camera initiates the capture of video and image data of the person. The one or more cameras may perform facial recognition on the person approaching the property 102 to determine that the person is not a resident of the property 102. For example, the camera capturing video data may compare the data to stored images of the residents to confirm the visitor is not a resident of the property 102. When the camera determines the person is a resident, the camera stops capturing video data. When the determines the person is not a resident, the person is identified as a visitor.

The control unit generates an appearance model of the visitor (320). The one or more external cameras, and the front door camera communicate the captured video and image data to the control unit. The control unit uses one or more different analytic techniques to analyze the physical characteristics of the visitor. The control unit 1112 may use a deep learning based human detection scheme to detect a human within captured video and or image data. The control unit 112 may generate a skeletal model of the detected human and may set one or more appearance features unique to the detected human. For example, the control unit 112 may use deep learning to generate a skeletal model of the human. The skeletal model may be refined based on model motion characteristics such as the gait of the human. The control unit 112 analyzes the gait of the visitor by determining the number of strides each second and the posture of the visitor. The skeletal model may be used to characterize body metrics of the human, for example, limb length. The control unit 112 may analyze the height of the visitor and the weight of the visitor. For example, the control unit 112 uses a trained convolutional neural network (CNN) to determine the height and weight of the human from the captured video and or image data. In some examples, where the camera that captures the image data of the human is a well calibrated camera the height or limb length measurements may be determined by direct geometric calculations. Based on the quality of the video data captured by the one or more cameras, the control unit 112 may analyze the facial features of the visitor. In some implementations, the control unit 112 may generate a three dimensional (3D) model of the detected human. In these implementations, a support vector machine may be used, along with the appearance model to identify features which are unique to the individual. For example, features such as eye color, hair length and nose shape may be analyzed to generate the model. In some examples, the control unit 112 may analyze the clothing worn by the visitor. For example, the color of the visitor's shirt and pants may be analyzed to generate the appearance model.

The visitor may unlock the front door of the property 102 using a physical key, or a pin code on a keypad door lock. The pin code may be a unique code provided to the visitor by the user. When the visitor accesses the property 102, an internal camera may capture one or more images of the visitor. The visitor moves to the control panel of the security system to disarm the system. In some examples, the disarm code may be the same as the pin code used to unlock the front door. The disarm code may be a unique time sensitive code that is provided to a particular visitor by the user. The user may log into a monitoring application that runs on the user mobile device to set up one or more visitor schedules for scheduled services. The user may specify the times for each expected visitor, may assign disarm codes, and the associated time period of validity for each disarm code. For example, the dog walker may be scheduled for 1:00 PM on Mondays and Wednesdays, the disarm code for the dog walker is 1234, and the code is valid from 12:30 PM to 2:30 PM on Mondays and Wednesdays only.

The user may also specify the rooms within the monitored property 102 that are restricted to the dog walker. For example, the user may identify that the bedrooms and the living room are restricted to the dog walker. The user may assign unique disarm codes to one or more expected visitors. For example, the user may assign the plumber with the disarm code of 2468 and the dog walker with the disarm code of 1234. The user may continually update and personalize the disarm codes and the scheduled times for each visitor. In some implementations, the disarm code may be generated by the monitoring server 114, and communicated to the user and the dog walker when the user schedules a visitor through the monitoring application. The control unit 112 may identify the user based on the code used to disarm the security system. For example, when the code 2468 is used to disarm the code, the control unit 112 identifies the visitor as the plumber.

In some implementations, the control unit 112 may disarm the monitoring system for one visitor, while the monitoring system remains armed for a second user. For example, a dog walker may arrive at the property and disarm the system, when the plumber arrives, the plumber must enter their unique disarm code to disarm the system. The system may track and monitor each of the different visitors as they move throughout the monitored property 102. When each of the visitors vacate the property, the system may log the departure time for each of the visitors.

The control panel of the security system includes a camera and may capture video and image data of the visitor as the visitor enters the disarm code. When the captured video and image data of the visitor captured by the camera of the control unit 112, the control unit 112 compares the data to the generated appearance model of the visitor approaching the property 102. Based on the captured data matching the generated appearance model, the control unit 112 confirms that the visitor that approached the property 102 is the same visitor that disarmed the security system. The control unit 112 associates the generated appearance model with the disarm code used by the visitor. The control unit 112 may also update the generated appearance model based on the newly received data.

A motion sensor detects one or more other persons within the property (330). When a motion sensor detects motion in a room of the monitored property 102, the control unit 112 prompts one or more surrounding cameras to capture video and image data of the room. Each room within the property 102 may be equipped with one or more cameras. At least one camera in the room with the tripped motion sensor may begin to capture video and image data. The at least one camera may identity one or more persons in the video and image data. The video and image data may be communicated to the control unit 1121. In some examples, one camera may detect one person from the video data and a second camera in a second room of the property 102 may detect a person at the same time, indicating to the control unit 112 that at least two persons are within the property 102.

The control unit compares the image and video data of the detected persons to the generated appearance model (340).

The control unit 112 may compare the video and image data obtained of each of the one or more persons to the generated appearance model. In the examples where one camera captures video and image data of one or more persons, the control unit 112 compares the data associated with each of the one or more persons to the generated appearance model. Based on the comparison, the control unit 112 identifies which of the one or more persons match the generated appearance model and which of the one or more persons do not match the generated model.

The control unit generates an alarm (350). In some implementations, the control unit 112 generates an alarm based on identifying more than one person within the video and image data received from the one or more cameras. For example, the dog walker arrives and a camera within the property identifies the dog walker and an additional person from the video and image data obtained from a camera within the property. In other implementations, the control unit 112 generates an alarm based on determining that a number of persons associated with the generated appearance is exceeded. In these implementations, when the visitor initially arrives at the monitored property 102 and the appearance model for the visitor is generated, the control unit 112 determines how many other persons are accompanying the visitor. Based on the initial determination, the control unit 112 may associate an allotted number of visitors with the generated model. For example, an electrician may approach the property 102 with one assistant, the control unit 112 may generate an appearance model for the electrician, and associates the generated appearance model with an additional person. When the control unit 112 receives video and image data from one or more cameras within the monitored property 102, the control unit 112 may generate an alarm condition based on determining that three or more persons are within the monitored property 102.

In some examples, the generated alarm may be an audible alarm. For example, the control unit 112 sounds the alarm system at the property 102. In other examples, control unit 1112 communicates a notification to the user. The notification may include which visitor caused the alarm, and the reason for the alarm. For example, the notification may include that the dog walker arrived with two unwarranted guests. In some examples, the control unit 112 may prompt a speaker at the property to sound an audible voice command instructing the unwarranted persons to leave the property or an alarm would be sounded.

Figure 4:
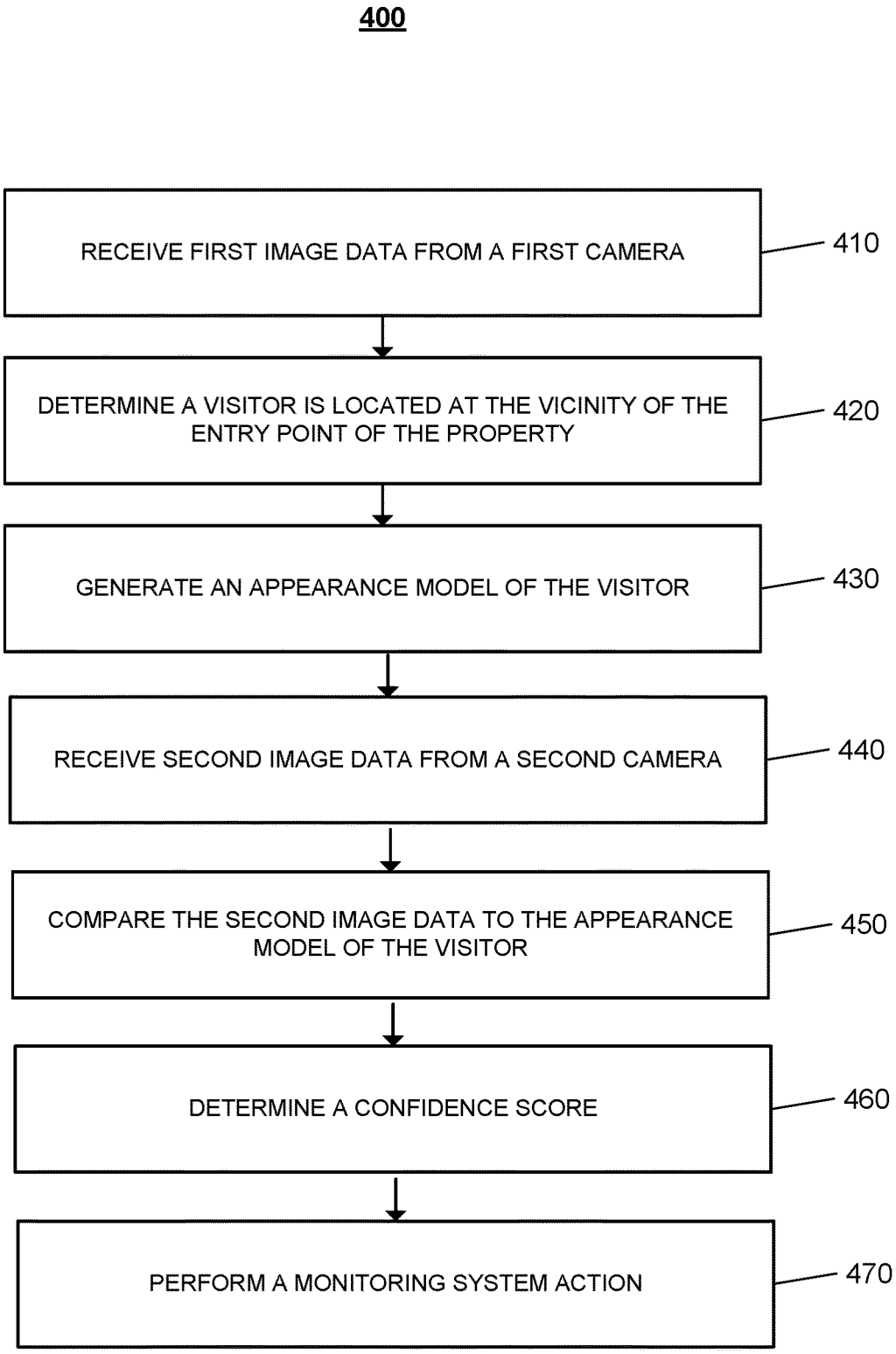
FIG. 4 is a flow chart of an example process for performing a monitoring system action.

FIG. 4 illustrates an example process 400 for performing a monitoring system action. The monitoring system includes a first camera that is configured to generate first image data and that is trained on a vicinity of an entry point of the monitored property 102, and a second camera that is configured to generate second image data and that is trained on an area of the property other than the vicinity of the entry point of the property 102. The monitoring control unit receives first image data from the first camera (410). The first camera may be located in the vicinity of the front door of the property 102 and may be configured to capture image and video data of a visitor as the visitor approaches the front door of the monitored property 102. In some implementations, the monitored property 102 may include one or more motion sensors that are located near the front door of the property 102. The first camera may be configured to initiate the capture of image and video data when at least one of the motion sensors that are located near the front door of the property 102 detects motion. The first camera may be configured to pan and or tilt to adjust its field of view to capture image and video data of a visitor as the visitor approaches the property. In some examples, the first camera may include a Passive Infrared Sensor (PIR) and a low power light sensitive sensor. The PIR sensor is configured to detect heat radiated from living objects, and the low power light sensitive sensor that is configured to distinguish between a human and an animal. In these examples, when the visitor moves into the field of view of the first camera, and determines the living object has a human form, the first camera initiates the capture of video and image data of the person. The first camera communicates the captured image and video data to the monitoring control unit 112 at the monitored property 102. The monitoring control unit determines that a visitor is located at the vicinity of the entry point of the property based on the first image data (420). Based on receiving the data from the first camera, the monitoring control unit 112 determines that a visitor is located at the vicinity of the entry point of the property 102.

The monitoring control unit generates an appearance model of the visitor (430). The monitoring control unit 112 uses one or more different analytic techniques to analyze the physical characteristics of the visitor. The monitoring control unit 112 may use a deep learning based human detection scheme to detect a human within the image data received from the first camera. The monitoring control unit 112 may generate a skeletal model of the detected visitor, and may set one or more appearance features unique to the detected human. In some implementations, the monitoring control unit 112 may use deep learning to generate a skeletal model of the visitor. The skeletal model may be refined based on model motion characteristics such as the gait of the visitor. The monitoring control unit 112 may analyze the gait of the visitor by determining the number of strides each second and the posture of the visitor. The skeletal model may be used to characterize body metrics of the visitor, for example, limb length, height, or any other suitable physical metric. The monitoring control unit 112 may analyze the height of the visitor and the weight of the visitor. In some implementations, the monitoring control unit 112 uses a trained convolutional neural network (CNN) to determine the height and weight of the visitor from the image data received from the first camera. In some examples, where the first camera is a well calibrated, the height or limb length measurements may be determined by direct geometric calculations.

In some implementations, the monitoring control unit 112 may analyze the facial features of the visitor. For example, when the image and video data captured by the first camera has a high resolution. In some implementations, the control unit 112 may generate a three dimensional (3D) model of the detected human. In these implementations, a support vector machine may be used, along with the appearance model to identify features which are unique to the individual. In other implementations, the monitoring control unit 112 may use support vector clustering techniques to analyze the facial features of the visitor. The vector clustering techniques may be used to differentiate the visitor from a set of specific individuals or differentiate the visitor from a generic population. For example, the monitoring control unit may use vector clustering techniques to differentiate the visitor from the one or more residents of the property. For example, features such as eye color, hair length and nose shape may be analyzed to generate the model. In some examples, the monitoring control unit 112 may analyze the clothing worn by the visitor.

The monitoring control unit receives second image data from a second camera (440). The second camera may be located at an interior location of the monitored property 102. For example, the second camera may be located at the hallway entrance of the property 102. In other examples, the camera may be located at the control panel. In these examples, when the visitor enters the property, using either a physical key, or a pin code on a keypad of the door lock, or through any other authorized method of entry, the visitor may then move to the control panel to disarm the monitoring system. The second camera may capture image and video data as the visitor enters the disarm code. The second camera communicates the image data to the monitoring control unit 112.

Each of the one or more cameras located throughout the monitored property 102 associates a time stamp with each of the images captured by the camera. A camera that detects a visitor in the vicinity of the front door of the property 102 captures an image of the visitor and communicates the time stamped image data to the monitoring control unit 112. The monitoring control unit 112 stores the time stamp data of each of the one or more received images. The monitoring control unit 112 uses the time stamp data from the captured images to make determinations based on the time and the position of each of the one or more cameras. For example, the monitoring control unit 112 may determine that a person that a person sighted in the outdoor camera cannot appear in the indoor camera simultaneously. For another example, the monitoring control unit 112 may determine a person sighted entering in the front porch camera is likely to immediately show up in the entryway camera next.

The monitoring control unit compares the second image data to the appearance model of the visitor based on determining that the second image data includes a representation of a person (450). The monitoring control unit 112 may use a deep learning based human detection scheme to detect a person in the second image data. The monitoring control unit 112 utilizes one or more different analytic techniques to compare the physical characteristics of the person in the second image data to the appearance model of the visitor. The monitoring control unit 112 compares the skeletal model of the person in the second image data to the skeletal model of the visitor in the generated appearance model. The monitoring control unit 112 may compare each of the one or more physical characteristics of the person in the second image data to the physical characteristics of the visitor.

The monitoring control unit determines a confidence score that reflects a likelihood that the visitor is located at the area of the property other than the vicinity of the entry point (460). The monitoring control unit 112 determines a confidence score that reflects the confidence in the determinations made when the person in the second image data is compared to the appearance model of the visitor. For example, the monitoring system may determine that the person in the second image data is the same as the visitor with a confidence of 98%.

The monitoring control unit performs a monitoring system action based on the confidence score that reflects a likelihood that the visitor is located at the area of the property other than the vicinity of the entry point (470). When the monitoring control unit 112 determines that the person in the second image is the same as the visitor with a confidence score that exceeds a confidence score threshold, the monitoring control unit 112 may switch on one or more lights at the property 102. For example, when the monitoring control unit determines that the person in the second image data is the visitor with a confidence score of 95%, the confidence score exceeds a confidence score threshold of 90%. When the monitoring control unit 112 determines that the person in the second image is the visitor with a confidence score that is below the confidence score threshold, the monitoring control unit 112 may sound an audible alarm at the property 102. For example, the monitoring control unit 112 determines that the person in the second image data is the visitor with a 75% confidence. The monitoring control unit 112 may perform a different monitoring system action based on the confidence score. For example, when the confidence score is below 50%, the monitoring control unit may sound an audible alarm at the property, and when the confidence score is between 50% and 75%, the monitoring control unit 112 may send a notification to the user device of a resident of the property 102. In some examples, when the monitoring control unit 112 determines that the person in the second image is the same as the visitor with a confidence score that exceeds a confidence score threshold, the monitoring control unit may log a time entry for the arrival of the visitor, and may log the visitor's movements throughout the property.

The monitoring control unit 112 may change the confidence score threshold based on the armed status of the monitoring system at the property 102. In some implementations, when the monitoring system is armed away, the monitoring control unit 112 may increase the confidence score threshold to 95%. In some implementations, when the monitoring system is disarmed, the monitoring control unit may decrease the confidence score threshold to 85%.

The monitoring control unit 112 may determine an identity of the visitor based on a user set timing schedule. The resident of the monitored property 102 may register one or more service providers to enter the monitored property 102. The user may set a schedule for a service and the monitoring control unit 112 may determine that the visitor is a scheduled visitor based on comparing the time of arrival of the visitor to the scheduled time of service. The user may log into a monitoring application that runs on the user mobile device to set up one or more visitor schedules for scheduled services. The user may specify the times for each expected visitor, and may assign disarm codes to be used by each of the one or more scheduled visitors. The user may set time period of validity for each disarm code.

The user may also specify one or more rooms that are restricted to a visitor. For example, the dog walker may be restricted from entering the bedrooms. When a visitor enters the monitored property 102 within a threshold time period of a scheduled time for a visitor, and the visitor enters the disarm code associated with the scheduled visitor, the system confirms that the visitor is the scheduled visitor. The user may specify a number of persons that are allowed to access the property 102 during a service appointment. For example, the user may specify that one person is allowed access when the dog walker comes to take the dog on a walk. In other examples, the user may allow access to two persons, for example, when the plumber is scheduled for maintenance. When the disarm code of a scheduled visitor is used to disarm the monitoring system, the monitoring control unit 112 ensures that only the allotted number of persons are within the property 102. The monitoring control unit 112 may compare the number of persons captured in the second image data to the allotted number of persons. When the monitoring control unit 112 determines that the second image data includes two persons, the monitoring control unit 112 may generate an alarm. The monitoring control unit 112 may receive image data from the one or more cameras located throughout that monitored property 102 when the visitor enters the property. Each of the one or more cameras communicate the image data to the monitoring control unit 112 and the monitoring control unit 112 compares each image that include a person to the appearance model of the visitor. The monitoring control unit 112 may update the appearance model for the visitor based on receiving the image data from the one or more camera located throughout the property 102. The monitoring control unit 112 may generate an alarm when a camera within the property 102 detects a person that does not match the appearance model of the visitor.

In some implementations, the monitoring control unit 112 may store one or more appearance models for one or more return visitors. For example, the monitoring control unit 112 may store the appearance model for the dog walker, the nanny, and the plumber in association with their assigned disarm codes. The monitoring control unit 112 may update the stored appearance model for each known visitor each time the known visitor enters the property 102.

The monitoring control unit 112 may determine the visitor is in a restricted room when a camera in a restricted room captures image data of a person in the restricted room. The camera communicates the image data to the monitoring control unit 112 and the monitoring control unit 112 compares the image data to the appearance model of the visitor. The monitoring control unit 112 may prompt a speaker in the restricted room, or a speaker in the vicinity, to output a voice commands instructing the visitor to vacate the restricted room.

The described systems, methods, and techniques may be implemented in digital electronic circuitry, computer hardware, firmware, software, or in combinations of these elements. Apparatus implementing these techniques may include appropriate input and output devices, a computer processor, and a computer program product tangibly embodied in a machine-readable storage device for execution by a programmable processor. A process implementing these techniques may be performed by a programmable processor executing a program of instructions to perform desired functions by operating on input data and generating appropriate output. The techniques may be implemented in one or more computer programs that are executable on a programmable system including at least one programmable processor coupled to receive data and instructions from, and to transmit data and instructions to, a data storage system, at least one input device, and at least one output device. Each computer program may be implemented in a high-level procedural or object-oriented programming language, or in assembly or machine language if desired; and in any case, the language may be a compiled or interpreted language. Suitable processors include, by way of example, both general and special purpose microprocessors. Generally, a processor will receive instructions and data from a read-only memory and/or a random access memory. Storage devices suitable for tangibly embodying computer program instructions and data include all forms of non-volatile memory, including by way of example semiconductor memory devices, such as Erasable Programmable Read-Only Memory (EPROM), Electrically Erasable Programmable Read-Only Memory (EEPROM), and flash memory devices; magnetic disks such as internal hard disks and removable disks; magneto-optical disks; and Compact Disc Read-Only Memory (CD-ROM). Any of the foregoing may be supplemented by, or incorporated in, specially-designed ASICs (application-specific integrated circuits).

It will be understood that various modifications may be made. For example, other useful implementations could be achieved if steps of the disclosed techniques were performed in a different order and/or if components in the disclosed systems were combined in a different manner and/or replaced or supplemented by other components. Accordingly, other implementations are within the scope of the disclosure.

The invention claimed is:

1. A monitoring system that is configured to monitor a property, the monitoring system comprising:

a first camera that is located at an exterior of the property and that is configured to generate image data of an area outside of the property;

a second camera that is located at an interior of the property and that is configured to generate image data of an area inside of the property;

a computer that is configured to:

access first image data of a visitor generated by the first camera;

based on the accessed first image data of the visitor, generate an appearance model of the visitor;

detect one or more persons within the property monitored by the monitoring system;

based on detection of the one or more persons within the property monitored by the monitoring system, access second image data of the detected one or more persons generated by the second camera;

compare the second image data of the detected one or more persons to the generated appearance model; and based on comparison of the second image data of the detected one or more persons to the generated appearance model, generate an alarm.

2. The monitoring system of claim 1, wherein the computer is configured to access the first image data of the visitor generated by the first camera by:

performing facial recognition on the visitor approaching the property;

determining that the visitor is not a resident of the property based on the facial recognition; and identifying the visitor for generation of the appearance model based on the determination that the visitor is not a resident of the property.

3. The monitoring system of claim 1, wherein the computer is configured to generate the appearance model of the visitor by using deep learning to generate a skeletal model of the visitor and refining the skeletal model based on model motion characteristics of the visitor.

4. The monitoring system of claim 1, wherein the computer is configured to generate the appearance model of the visitor by training a convolutional neural network to determine a height and weight of the visitor from the accessed first image data.

5. The monitoring system of claim 1, wherein the computer is configured to generate the appearance model of the visitor by analyzing facial features of the visitor based on quality of the accessed first image data.

6. The monitoring system of claim 1, wherein the computer is configured to generate the appearance model of the visitor by generating a three dimensional (3D) model of the visitor using a support vector machine of features including eye color, hair length and nose shape.

7. The monitoring system of claim 1, wherein the computer is configured to generate the appearance model of the visitor by analyzing clothing worn by the visitor.

8. The monitoring system of claim 1, wherein the computer is configured to compare the second image data of the detected one or more persons to the generated appearance model by identifying which of the detected one or more persons match the generated appearance model and which of the one or more persons do not match the generated appearance model.

9. The monitoring system of claim 1, wherein the computer is configured to generate the alarm based on a determination that a number of persons associated with the generated appearance model is exceeded.

10. The monitoring system of claim 1:

wherein the computer is configured to generate the appearance model of the visitor by determining that an additional person is with the visitor in the first image data and associating the generated appearance model with the additional person; and wherein the computer is configured to generate the alarm based on a determination that the detected one or more persons includes more than the visitor and the additional person associated with the generated appearance model.

11. A computer-implemented method comprising:

accessing first image data of a visitor generated by a first camera that is located at an exterior of a property monitored by a monitoring system and that is configured to generate image data of an area outside of the property;

based on the accessed first image data of the visitor, generating an appearance model of the visitor;

detecting one or more persons within the property monitored by the monitoring system;

based on detection of the one or more persons within the property monitored by the monitoring system, accessing second image data of the detected one or more persons generated by a second camera that is located at an interior of the property and that is configured to generate image data of an area inside of the property;

comparing the second image data of the detected one or more persons to the generated appearance model; and based on comparison of the second image data of the detected one or more persons to the generated appearance model, generating an alarm.

12. The method of claim 11, wherein accessing the first image data of the visitor generated by the first camera comprises:

performing facial recognition on the visitor approaching the property;

determining that the visitor is not a resident of the property based on the facial recognition; and identifying the visitor for generation of the appearance model based on the determination that the visitor is not a resident of the property.

13. The method of claim 11, wherein generating the appearance model of the visitor comprises using deep learning to generate a skeletal model of the visitor and refining the skeletal model based on model motion characteristics of the visitor.

14. The method of claim 11, wherein generating the appearance model of the visitor comprises training a convolutional neural network to determine a height and weight of the visitor from the accessed first image data.

15. The method of claim 11, wherein generating the appearance model of the visitor comprises analyzing facial features of the visitor based on quality of the accessed first image data.

16. The method of claim 11, wherein generating the appearance model of the visitor comprises generating a three dimensional (3D) model of the visitor using a support vector machine of features including eye color, hair length and nose shape.

17. The method of claim 11, wherein generating the appearance model of the visitor comprises analyzing clothing worn by the visitor.

18. The method of claim 11, wherein comparing the second image data of the detected one or more persons to the generated appearance model comprises identifying which of the detected one or more persons match the generated appearance model and which of the one or more persons do not match the generated appearance model.

19. The method of claim 11, wherein generating the alarm comprises generating the alarm based on a determination that a number of persons associated with the generated appearance model is exceeded.

20. The method of claim 11:

wherein generating the appearance model of the visitor comprises determining that an additional person is with the visitor in the first image data and associating the generated appearance model with the additional person; and wherein generating the alarm comprises generating the alarm based on a determination that the detected one or more persons includes more than the visitor and the additional person associated with the generated appearance model.

* * * * *